US005706750A

United States Patent [19]

Spademan

[11] Patent Number: 5,706,750

[45] Date of Patent: Jan. 13, 1998

[54] SAILBOAT SINGLE-HANDED REEFING SYSTEM

[76] Inventor: Richard G. Spademan, 2600 Capitol Ave., Sacramento, Calif. 95816

[21] Appl. No.: 766,235

[22] Filed: Dec. 13, 1996

Related U.S. Application Data

[63] Continuation of Ser. No. 598,585, Feb. 12, 1996, abandoned, which is a continuation-in-part of Ser. No. 473,629, Jun. 7, 1995, abandoned.

[51] Int. Cl.[6] ..... B63H 9/04

[52] U.S. Cl. ..... 114/105

[58] Field of Search ..... 114/39.1, 38.2, 114/101, 102, 103, 104, 105, 106, 17, 108

[56] References Cited

U.S. PATENT DOCUMENTS

| | | |
|---|---|---|
| 4,606,292 | 8/1986 | du Temple de Rougemont . |
| 4,688,506 | 8/1987 | van Breems . |
| 5,048,443 | 9/1991 | Brown . |

*Primary Examiner*—Stephen Avila

*Attorney, Agent, or Firm*—Townsend and Townsend and Crew LLP

[57] ABSTRACT

A single-handed reefing system for a sailboat including a sail, halyard, reefing line and winch mechanism. The reefing line is secured to the leach of a flexible sail approximately half the distance between the head and foot and passes alternately through rows of grommets spaced generally horizontally on the sail and fairleads secured on the boom and a turning block on the mast to a winch located at the cockpit. A sail halyard is secured to the head of the sail and passes upward through a turning block located at the upper end of the mast and then downward to a turning block on the mast and then to the winch which has two drums, each with an appropriate circumference to allow the halyard wrapped in one direction on the first drum to lower the upper portion of the sail a distance and rate generally coincident with the lowering and reefing of the lower portion of the sail by the reefing line wrapped in the opposite direction on the second drum. Removable stops can be positioned on the reefing line to accomplish several levels of reefing.

5 Claims, 3 Drawing Sheets

SAILBOAT SINGLE-HANDED REEFING SYSTEM

CROSS-REFERENCE TO RELATED APPLICATIONS

This is a File Wrapper Continuation application of U.S. application Ser. No. 08/598,585, filed Feb. 12, 1996, which is a Continuation-in-part of U.S. application Ser. No. 08/473,629, filed Jun. 7, 1995, both now abandoned.

BACKGROUND OF THE INVENTION

This invention relates to an improvement in sail reefing which allows one sailor to lower and reef a flexible sail to reduce the sail size in an extreme wind and storm condition from one position such as the cockpit. Historically, reefing has generally been accomplished by loosening the sail halyard and lowering the sail and then moving along the boom to bunch or flake the sail and then tie reefing lines around the boom to secure the doused lower portion of the sail. This activity has often been awkward and dangerous in a rising sea and wind condition and difficult and time consuming for one sailor to accomplish. More recently roller systems located in or at the mast or boom have been developed which are complicated, unreliable and very expensive in addition to compromising the sail shape and thus sail performance.

SUMMARY OF THE INVENTION

A primary object of the present invention is to provide a sail reefing system that is simple and can be efficiently operated by one crewperson from the safety of the cockpit.

Another object of the invention is to provide a reefing system that does not appreciably affect sail shape and performance.

Still another object of the present invention is to provide a reefing system that is reliable under adverse conditions.

A further object of the present invention is to provide a reefing system that can accommodate to presently available sails and winches and is inexpensive.

The present single-handed reefing system disclosure provides a mechanism for efficiently reefing a sail by one person from the safety of the cockpit. The invention includes a reefing line, or pendant, that is secured through a grommet, or cringle, at the sail leach approximately midway between the head and foot of the sail. The reefing line then passes downward through a grommet located approximately one-half the distance between the leach grommet and a fairlead located on the side of the boom. The reefing line then passes downward on the other side of the sail through a second grommet to the fairlead. The reefing line then passes upward and downward on each side of the sail through successive horizontally parallel grommets and fairleads on each side of the sail and boom to a fairlead or turning block located below the boom level on the mast and then to a uniquely configured control mechanism providing a mechanical advantage such as a winch located at the cockpit.

The sail halyard is secured to the head of the sail and then passes upward to a fairlead or block at the upper end of the mast and then downward to a fairlead or block below the boom level and then to the aforementioned winch at the cockpit.

The halyard and reefing line are wrapped in opposite directions around separate drums on the winch. The circumference of each drum is designed to accommodate the halyard and reefing line to allow the halyard to be reeled out and thus lower the upper portion of the sail generally the same distance and rate as the lower portion of the sail is lowered and automatically flaked and reefed due to the sail lacing system being reeled in. The reefing line and the halyard are then secured by cleats or the like. Stops in the form of grooved rubber balls can be press friction fit on the reefing line to act as stops to allow several levels of reefing of the sail for several levels of sail size.

REFERENCE NUMERALS IN DRAWINGS

| | |
|---|---|
| 1 sailboat | 2 mast |
| 3 forestay | 4 backstay |
| 5 mainsail | 6 luff |
| 7 sail slides | 8 track |
| 9 foot | 10 boom |
| 11 battens | 12 reefing line |
| 13 grommet | 14 leach |
| 15 fairlead | 16 turning block |
| 17 winch | 18 cockpit |
| 19 mainsail halyard | 20 head |
| 21 double drum | 22 winch drum |
| 23 hose clamp | 24 reefing line drum |
| 25 halyard line drum | 26 winch handle |
| 27 double drum end | 28 stop |
| 29 stop groove | 30 sailboat |
| 31 mainsail | 32 luff |
| 33 mast | 34 sailslides |
| 35 groove | 36 foot |
| 37 boom | 38 battens |
| 39 first reefing line | 40 grommet |
| 41 leach | 42 head |
| 43 fairlead | 44 triple turning block |
| 45 winch | 46 second reefing line |
| 47 grommet | 48 forward fairlead |
| 49 mainsail halyard | 50 grommet |
| 51 rubber triple drum | 52 winch drum |
| 53 shim | 54 drum base |
| 55 drum wall | 56 shim |
| 57 first reefing line drum | 58 second reefing line drum |
| 59 mainsail halyard drum | 60 stop |

DETAILED DESCRIPTION OF THE PREFERRED EMBODIMENT

Figure 1:
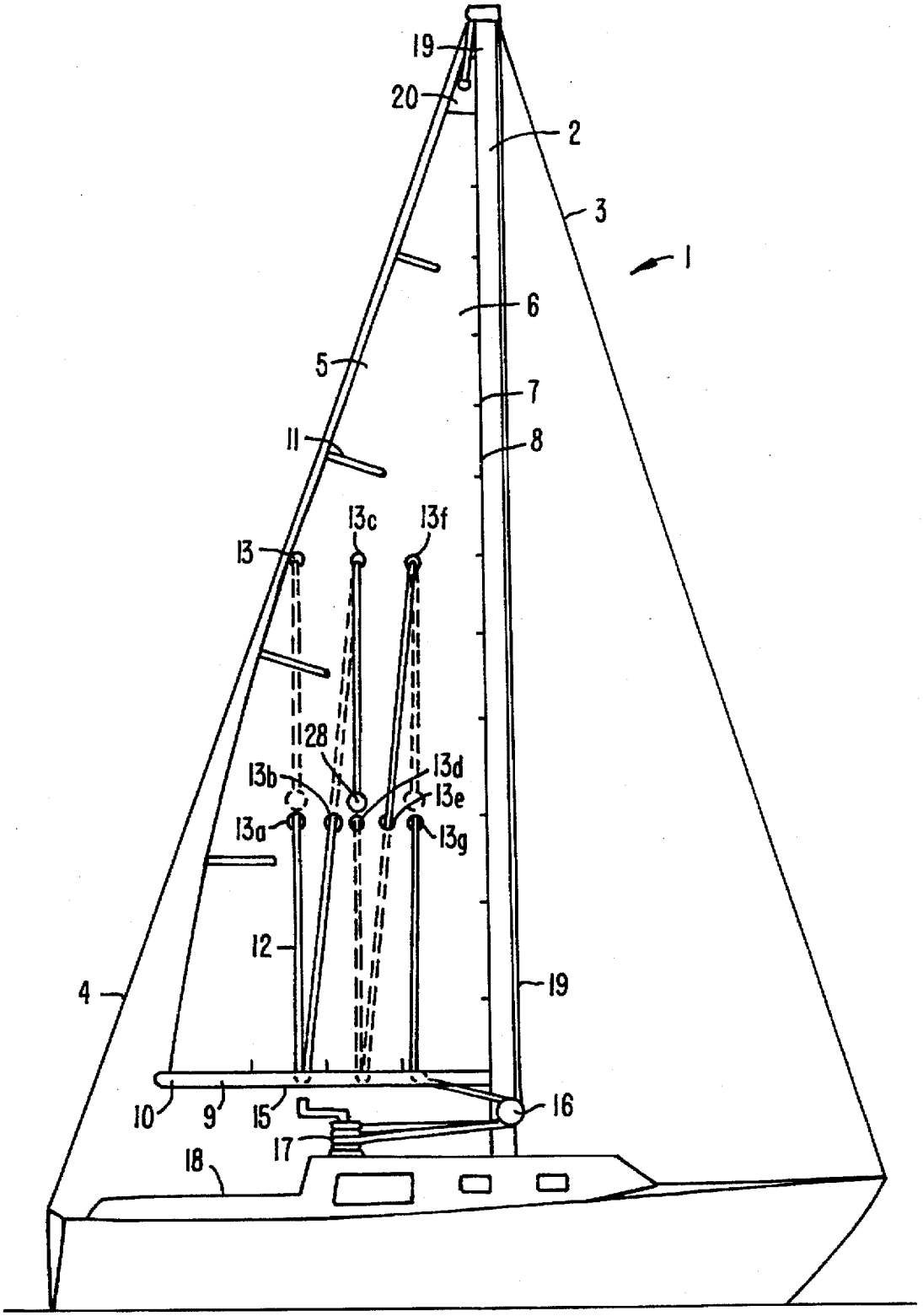
FIG. 1 is a side elevation view of a sailboat with the mainsail in the raised position including the single-handed reefing system according to the invention.
Figure 2:
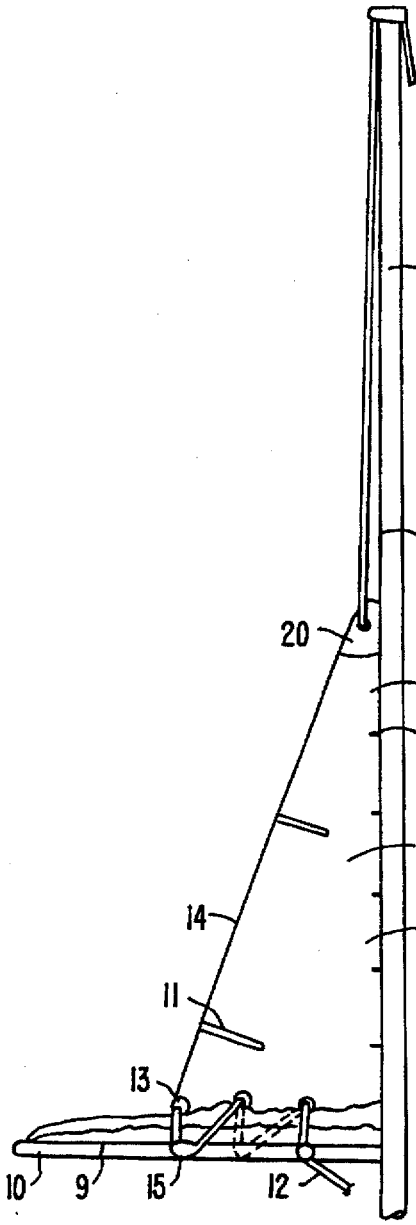
FIG. 2 is a side elevation view of the sail, mast and boom of FIG. 1 with the sail in the second level reefed position.
Figure 3:
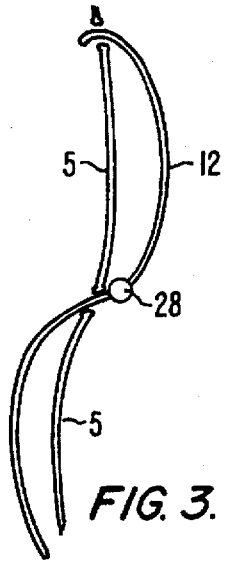
FIG. 3 is an enlarged partial end view of the sail of FIG. 1 showing the lacing and stop system.

Referring to FIGS. 1, 2 and 3, a sailboat (1) includes a mast (2) supported by a forestay (3), backstay (4) and lateral shrouds (not shown). A flexible mainsail (5) forward edge or luff (6) is slidably secured to the mast (2) by sail slides (7) engaged by a track or groove (8) and secured at the bottom edge or foot (9) to the boom (10) by sail slides (7) engaged by a track or groove (8) or the like. The sail can incorporate battens (11). A lacing system including a reefing line (12) is secured through a grommet (13) to the rearward edge or leach (14) of the sail. The reefing line (12) then passes downwardly and slidably through a grommet (13*a*) to the opposite side of the mainsail (5) to a fairlead (15) located on the side of the boom (10). The reefing line (12) then passes upwardly and slidably through a grommet (13*b*) and then the reefing line (12) passes on the opposite side of the mainsail (5) to a grommet (13*c*). The reefing line (12) then passes downwardly and upwardly and then downwardly on each side of the sail through a series of grommets (13*d–g*) and through a series of fairleads (15*a–d*) on each side of the boom to a double turning block (16) located below the boom level at the mast (2) to a uniquely configured winch (17) located at the cockpit (18) as shown in FIG. 1. The two levels of grommets (13) are positioned in the mainsail (5) in horizontal parallel arrangement to permit two levels of sail size reduction when reefing. Additional reefing point levels can be incorporated in the system.

A mainsail halyard (19) is secured through a grommet (13) or the like at the head (20) of the mainsail (5) and then passes upwardly through a turning block (not shown) at the upper end of the mast (2). The mainsail halyard (19) is then directed downwardly to the double turning block (16) to the winch (17) located at the cockpit (18).

Figure 4:
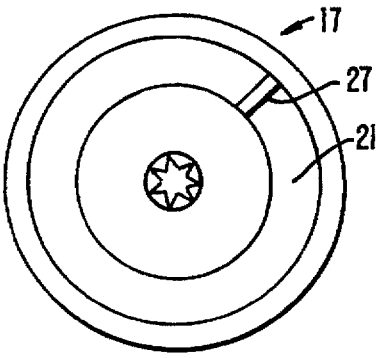
FIG. 4 is an enlarged top view of the winch of FIG. 1.
Figure 5:
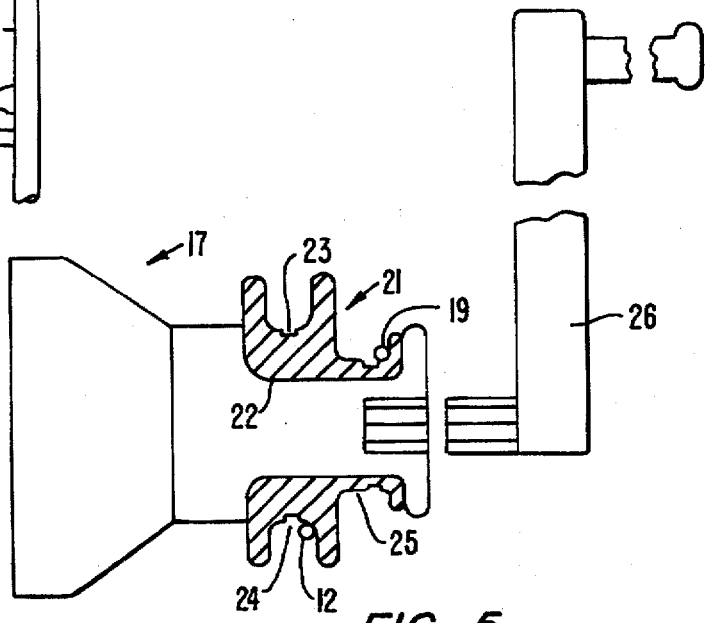
FIG. 5 is a partial cross sectional side view of the winch of FIG. 4 taken along line A—A of FIG. 4 showing the rubber double drum.

As particularly shown in FIGS. 4 and 5, a conventional winch (17) and winch handle (26) can be utilized single-handedly with the unique disclosed adapter and lacing system to both raise and lower the mainsail (5) and to douse or reef the mainsail (5). The internal gear mechanism, known per se, is not shown for clarity of illustration. An elastomeric type rubber double drum (21) which has opposing rubber double drum ends (27) is adjustably positioned on a conventional winch drum (22) and secured by hose clamps (23) or the like. The rubber double drum (21) can be adjusted to fit several size conventional drums by adjustment of the opposing ends and with the use of shims and can have ribs to increase friction against the conventional winch drum (22), reefing line (12) and mainsail halyard (19). The reefing line drum (24) and the halyard line drum (25) have a specific circumference to accommodate the mainsail halyard (19) and reefing line (12). The mainsail grommets (13) and boom fairleads (15) are positioned to accommodate reeling in the appropriate length of reefing line (12) and wrapping the reefing line about the winch (17) rubber double drum (21) reefing line drum (24) as the length of the mainsail halyard (19) which is wrapped in the opposite direction from the reefing line (12) is reeled out from the halyard line drum (25) to maintain fullness of the mainsail (5) that is not being reefed.

Figure 6:
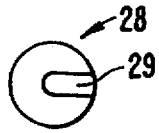
FIG. 6 is an enlarged top elevation view of a stop of FIG. 1.
Figure 7:
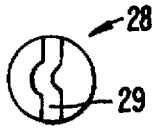
FIG. 7 is a cross sectional side view of the stop of FIG. 6.

A stop (28) in the form of a rubber ball as particularly shown in FIGS. 1, 6 and 7 has a curved stop groove (29) to accommodate the press friction fit of the reefing line (12) and prevent the reefing line (12) from passing through a grommet (13) when the stop (28) is pressed against the grommet (13). A series of these stops (28) are positioned on marks on the reefing line (12) at locations just above the lower level of alternate grommets (13*a*) and (13*d*) and (13*g*) to prevent the reefing line (12) from passing through the grommets thus reefing the lower level of sail against the boom (10). Removal of the stops (28) from the reefing line (12) by pulling the reefing line (12) out of the stop groove (29) permits the mainsail to be reefed at the second level as shown in FIG. 2.

In use, as the winch handle, winch drum and rubber triple drum are turned by the crewperson, the mainsail is lowered as the mainsail halyard is reeled out, and, as the reefing lines are reeled in and the reefing line flakes the mainsail and the stops reef the mainsail against the boom.

Figure 9:
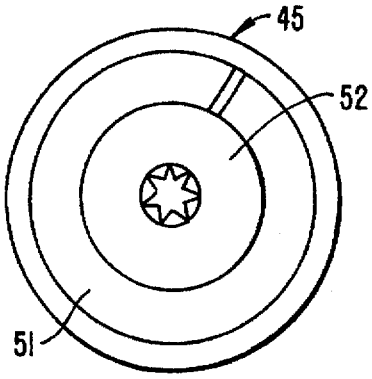
FIG. 9 is an enlarged top view of the winch of FIG. 8.
Figure 10:
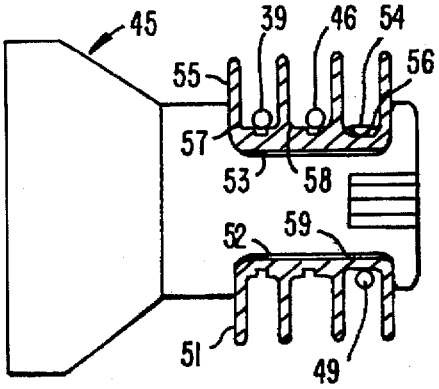
FIG. 10 is a partial cross sectional side view of the winch of FIG. 9 taken along line A—A of FIG. 9 showing the rubber triple drum.
Figure 8:
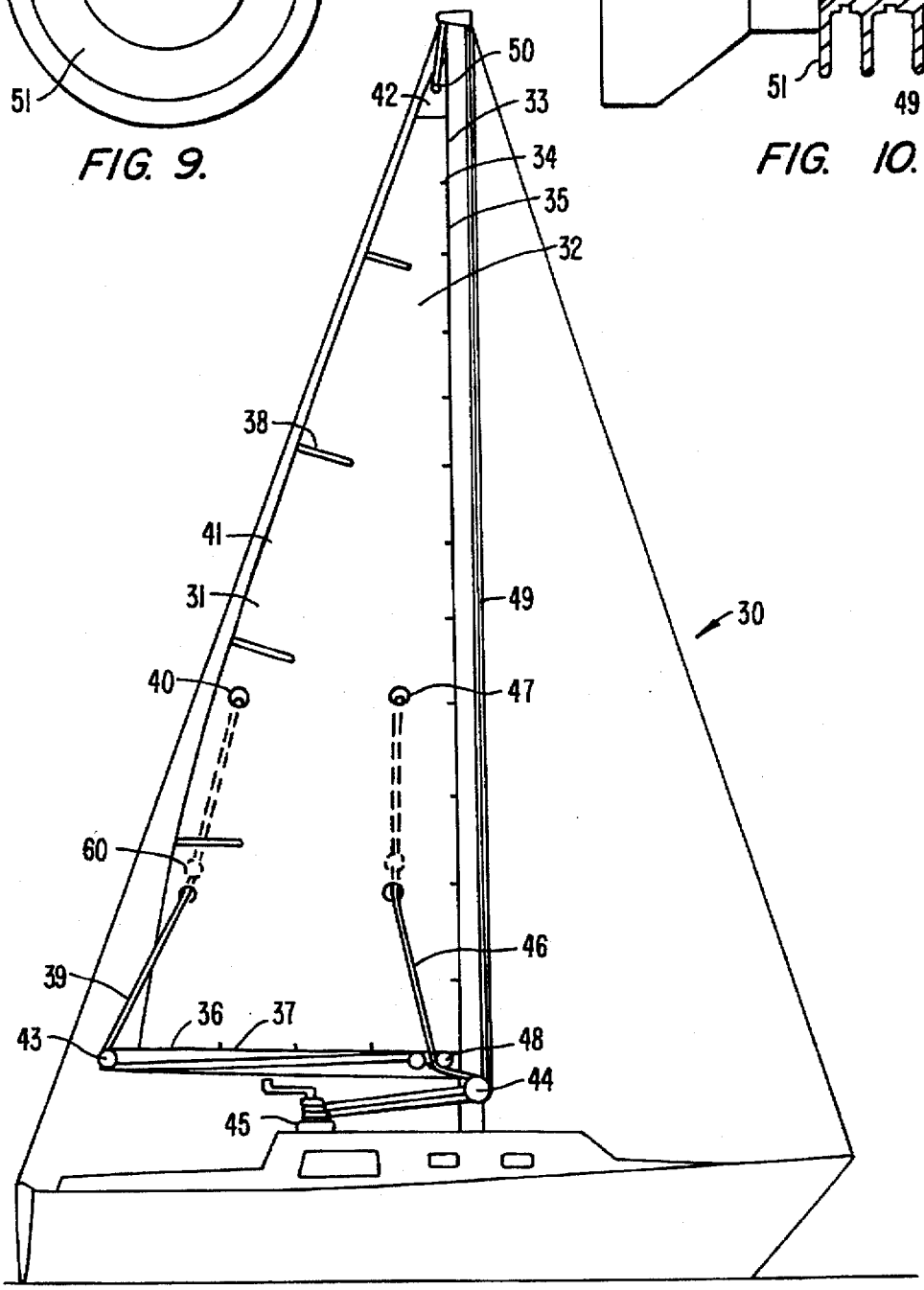
FIG. 8 is a side elevation view of a sailboat with the mainsail in the raised position including the singlehanded reefing system according to an alternative embodiment of the invention.

Referring to FIGS. 8, 9 and 10 in another embodiment of the present invention, a sailboat (31) flexible mainsail (31) forward edge or luff (32) is slidably secured to a mast (33) by sail slides (34) engaged by a track or groove (35) and secured at the bottom edge or foot (36) to a boom (37) by sail slides (34) engaged by a track or groove (35) or the like. The sail can incorporate battens (38). A lacing system including a first reefing line (39) is secured through a grommet (40) to the rearward edge or leach (41) of the mainsail (31) approximately one third of the distance from the foot (36) to the head (42). The first reefing line (39) then passes downwardly and slidably through a grommet (40*a*) located approximately one half of the distance from the foot (36) to the grommet (40). The first reefing line (39) then passes on the opposite side of the mainsail (31) through an aft fairlead (43) located on the aft end side of the boom (37) and then forwardly through a fairlead (43*a*) located on the forward end side of the boom (37). The first reefing line (39) then passes to a triple turning block (44) to a winch (45). Alternately, the aft fairlead can be located at the aft end of a hollow boom and then the reefing line passes through the hollow boom to a fairlead located at the forward end of the boom, to the triple turning block to the winch.

A second reefing line (46) can be secured through a grommet (47) near the forward edge or luff (32) of the mainsail (31) approximately parallel to the grommet (40). The second reefing line (46) then passes downwardly and slidably through a grommet (47*a*) approximately parallel to grommet (40*a*). The second reefing line then passes downwardly on the opposite side of the mainsail (31) through a forward fairlead (48) located on the forward end side of the boom (37). The second reefing line (46) is then directed forward to the triple turning block (44) and then directed aft to the winch (45) located at the cockpit.

A mainsail halyard (49) is secured through a grommet (50) or the like at the head (42) of the mainsail (31) and then passes upwardly to a turning block (not shown) at the upper end of the mast (33) and then downwardly to the triple turning block (44) to the winch (45) located at the cockpit.

As particularly shown in FIG. 10, a conventional winch (45) and a winch handle (not shown) can be utilized single-handedly with the use of the lacing system and a unique rubber triple drum (51) to raise and lower and dowse and reef the mainsail (31). An elastomeric rubber or the like triple drum (51) which has opposing ends is adjustably positioned on a conventional winch drum (52) and secured by hose clamps (53) or the like. The rubber triple drum (51) can be adjusted to fit several size conventional winch drums by adjusting the position of the opposing ends of the rubber triple drum (51) and with the use of a shim (53). The diameter of each rubber triple drum base (54) which is separated from the adjacent drum base (54) by a drum wall (55) can also be adjusted with the use of a shim (56). The first reefing line drum (57) and second reefing line drum (58) and mainsail halyard drum (59) have a specific circumference to maintain the fullness of the sail not being reefed when reeling of the mainsail halyard (49) the first reefing line (50) and the second reefing line (46). Separate drums can be utilized. The main sail halyard (49) is wrapped in the opposite direction from the first reefing line (39) and the second reefing line (46).

A grooved removable rubber stop (60) is press fit on the first reefing line (39) and the second reefing line (46). Each stop (60) prevents the first reefing line (39) and second reefing line (46) from passing through grommet (40*a*) and grommet (47*a*) respectively, thus reefing the lower level of sail agains the boom (37). Removal of each stop (60) permits the mainsail (31) to reef at the second level.

Although this disclosure describes unique lacing and winching systems for a single-handed reef of a mainsail, the system is also applicable to other sails secured to a mast and boom such as a mizzen or staysail. The numerous modifications are within the scope of the claims.

I claim:

1. A single-handed reefing system for a sailboat comprising:

a mast terminating in an upper end;

a boom extending from the mast terminating in an outer end;

a flexible sail lower edge secured to the boom;

a forward edge secured to the mast and slidable relative to the mast;

a sail upper end secured to a halyard passing upward through a fairlead at the upper end of the mast and downward to a winch providing a mechanical advantage which simultaneously controls the unreeling of the halyard and reeling of a reefing line;

a reefing line connected to the sail and passing to the winch, the winch including multiple drums for wrapping the halyard and reefing line.

2. A single-handed reefing system according to claim 1 wherein the multiple drums can be adjustably positioned on a winch drum.

3. A single-handed reefing system according to claim 1 wherein the reefing line passes upward and downward on each side of the sail through successive horizontally placed parallel grommets and fairleads.

4. A single-handed reefing system according to claim 1 wherein a removable reefing line stop prevents movement of the reefing line through a grommet.

5. A single-handed reefing system for a sailboat comprising:

a mast terminating in an upper end;

a boom extending from the mast terminating in an outer end;

a flexible sail having a lower edge secured to the boom and a forward edge secured to the mast and slidable relative to the mast;

the sail having an upper end secured to a halyard passing upward through a fairlead at the upper end of the mast and downward to a control mechanism which simultaneously controls the unreeling of the halyard and reeling of a reefing line at different rates; and a reefing line connected to the sail and passing to the control mechanism.

* * * * *